US006027685A

United States Patent [19]

Cooper

[11] Patent Number: 6,027,685

[45] Date of Patent: Feb. 22, 2000

[54] FLOW-DIRECTING DEVICE FOR MOLTEN METAL PUMP

[76] Inventor: Paul V. Cooper, 11247 Lake Forest Dr., Chesterland, Ohio 44026

[21] Appl. No.: 08/951,007

[22] Filed: Oct. 15, 1997

[51] Int. Cl.[7] ..... C21C 7/00

[52] U.S. Cl. ..... 266/44; 266/217; 266/233

[58] Field of Search ..... 266/44, 217, 233; 75/10.39

[56] References Cited

U.S. PATENT DOCUMENTS

| | | |
|---|---|---|
| 506,572 | 10/1893 | Wagener . |
| 585,188 | 6/1897 | Davis . |
| 1,100,475 | 6/1914 | Franckaerts . |
| 1,454,967 | 5/1923 | Gill . |
| 1,518,501 | 12/1924 | Gill . |
| 1,522,765 | 1/1925 | Wilke . |
| 1,526,851 | 2/1925 | Hall . |
| 1,673,594 | 6/1928 | Schmidt . |
| 1,896,201 | 2/1933 | Sterner-Rainer . |
| 2,038,221 | 4/1936 | Kagi . |
| 2,290,961 | 7/1942 | Heuer . |
| 2,488,447 | 11/1949 | Tangen et al. . |
| 2,515,478 | 7/1950 | Tooley et al. . |
| 2,566,892 | 9/1951 | Jacobs . |
| 2,677,609 | 5/1954 | Moore et al. . |
| 2,698,583 | 1/1955 | House et al. . |
| 2,787,873 | 4/1957 | Hadley . |
| 2,808,782 | 10/1957 | Thompson et al. . |
| 2,821,472 | 1/1958 | Peterson et al. . |
| 2,832,292 | 4/1958 | Edwards . |
| 2,865,618 | 12/1958 | Abell . |
| 2,901,677 | 8/1959 | Chessman et al. . |
| 2,948,524 | 8/1960 | Sweeney et al. . |
| 2,978,885 | 4/1961 | Davison . |
| 2,984,524 | 5/1961 | Franzen . |
| 2,987,885 | 6/1961 | Hodge . |
| 3,048,384 | 8/1962 | Sweeney et al. . |
| 3,070,393 | 12/1962 | Silverberg et al. . |
| 3,092,030 | 6/1963 | Wunder . |
| 3,227,547 | 1/1966 | Szekely . |
| 3,251,676 | 5/1966 | Johnson . |

(List continued on next page.)

FOREIGN PATENT DOCUMENTS

| | | |
|---|---|---|
| 1185314 | 3/1970 | United Kingdom . |

OTHER PUBLICATIONS

Communication relating to the resulsts of the Partial International search report for PCT/US97/22440 dated May 13, 1998.

*Primary Examiner*—Scott Kastler

*Attorney, Agent, or Firm*—David E. Rogers; Michael A. Lechter; Squire, Sanders & Dempsey L.L.P.

[57] ABSTRACT

A system and device for introducing gas into molten metal comprises: 1) a pump having a pump chamber and a discharge, 2) a gas-release device for releasing gas into the discharge, and 3) a flow-directing device to substantially reduce or eliminate the low-pressure zone behind the gas-release device. The pump creates a stream of molten metal through the discharge. The gas-release device, which is preferably a graphite tube, has an end extending into the discharge. Gas is introduced through the gas-release device into the discharge where it escapes into the molten metal stream passing therethrough. The flow-directing device is positioned behind the end of the gas-release device to eliminate the low pressure zone that normally forms there. During operation, the molten metal is diverted around the sides and bottom of the flow-directing device and the gas is dispersed within the molten metal, rather than being trapped in a low-pressure zone. The system may also comprise a metal-transfer device, such as a conduit extending from the pump outlet, for containing the molten metal stream. In that case, if the gas-release device releases gas into the metal-transfer device, the flow-blocking device is positioned within the metal-transfer device downstream of the gas-release device.

33 Claims, 11 Drawing Sheets

U.S. PATENT DOCUMENTS

| | | |
|---|---|---|
| 3,255,702 | 6/1966 | Gehrm . |
| 3,272,619 | 9/1966 | Sweeney et al. . |
| 3,289,473 | 12/1966 | Louda . |
| 3,291,473 | 12/1966 | Sweeney et al. . |
| 3,400,923 | 9/1968 | Howie et al. . |
| 3,459,346 | 8/1969 | Tinnes . |
| 3,487,805 | 1/1970 | Satterthwaite . |
| 3,512,762 | 5/1970 | Umbricht . |
| 3,575,525 | 4/1971 | Fox et al. . |
| 3,618,917 | 11/1971 | Fredrikson . |
| 3,650,730 | 3/1972 | Derham et al. . |
| 3,689,048 | 9/1972 | Foulard et al. . |
| 3,715,112 | 2/1973 | Carbonnel . |
| 3,743,263 | 7/1973 | Szekely . |
| 3,743,500 | 7/1973 | Foulard et al. . |
| 3,753,690 | 8/1973 | Emley et al. . |
| 3,759,635 | 9/1973 | Carter et al. . |
| 3,767,382 | 10/1973 | Bruno et al. . |
| 3,785,632 | 1/1974 | Kraemer et al. . |
| 3,814,400 | 6/1974 | Seki . |
| 3,836,280 | 9/1974 | Koch . |
| 3,839,019 | 10/1974 | Bruno et al. . |
| 3,871,872 | 3/1975 | Downing et al. . |
| 3,873,305 | 3/1975 | Claxton et al. . |
| 3,886,992 | 6/1975 | Maas et al. . |
| 3,915,694 | 10/1975 | Ando . |
| 3,954,134 | 5/1976 | Maas et al. . |
| 3,961,778 | 6/1976 | Carbonnel et al. . |
| 3,972,709 | 8/1976 | Chin et al. . |
| 3,984,234 | 10/1976 | Claxton et al. . |
| 3,997,336 | 12/1976 | van Linden et al. . |
| 4,003,560 | 1/1977 | Carbonnel . |
| 4,018,598 | 4/1977 | Markus . |
| 4,052,199 | 10/1977 | Mangalick . |
| 4,128,415 | 12/1978 | van Linden et al. . |
| 4,169,584 | 10/1979 | Mangalick . |
| 4,286,985 | 9/1981 | van Linden et al. . |
| 4,322,245 | 3/1982 | Claxton . |
| 4,351,514 | 9/1982 | Koch . |
| 4,360,314 | 11/1982 | Pennell . |
| 4,370,096 | 1/1983 | Church . |
| 4,372,541 | 2/1983 | Bocourt et al. . |
| 4,392,888 | 7/1983 | Eckert et al. . |
| 4,410,299 | 10/1983 | Shimoyama . |
| 4,456,424 | 6/1984 | Araoka . |
| 4,504,392 | 3/1985 | Groteke . |
| 4,537,624 | 8/1985 | Tenhover et al. . |
| 4,537,625 | 8/1985 | Tenhover et al. . |
| 4,556,419 | 12/1985 | Otsuka et al. . |
| 4,557,766 | 12/1985 | Tenhover et al. . |
| 4,598,899 | 7/1986 | Cooper . |
| 4,609,442 | 9/1986 | Tenhover et al. . |
| 4,611,790 | 9/1986 | Otsuka et al. . |
| 4,634,105 | 1/1987 | Withers et al. . |
| 4,640,666 | 2/1987 | Sodergard . |
| 4,696,703 | 9/1987 | Henderson et al. . |
| 4,701,226 | 10/1987 | Henderson et al. . |
| 4,717,540 | 1/1988 | McRae et al. . |
| 4,743,428 | 5/1988 | McRae et al. . |
| 4,770,701 | 9/1988 | Henderson et al. . |
| 4,786,230 | 11/1988 | Thut . |
| 4,802,656 | 2/1989 | Hudault et al. . |
| 4,804,168 | 2/1989 | Otsuka et al. . |
| 4,810,314 | 3/1989 | Henderson et al. . |
| 4,842,227 | 6/1989 | Harrington et al. . |
| 4,844,425 | 7/1989 | Piras et al. . |
| 4,851,296 | 7/1989 | Tenhover et al. . |
| 4,859,413 | 8/1989 | Harris et al. . |
| 4,884,786 | 12/1989 | Gillespie . |
| 4,898,367 | 2/1990 | Cooper . |
| 4,923,770 | 5/1990 | Grasselli et al. . |
| 4,930,986 | 6/1990 | Cooper . |
| 4,931,091 | 6/1990 | Waite et al. . |
| 4,940,214 | 7/1990 | Gillespie . |
| 4,940,384 | 7/1990 | Amra et al. . |
| 4,954,167 | 9/1990 | Cooper . |
| 4,973,433 | 11/1990 | Gilbert et al. . |
| 5,028,211 | 7/1991 | Mordue et al. . |
| 5,078,572 | 1/1992 | Amra et al. . |
| 5,092,821 | 3/1992 | Gilbert et al. . |
| 5,098,134 | 3/1992 | Monckton . |
| 5,131,632 | 7/1992 | Olson . |
| 5,143,357 | 9/1992 | Gilbert et al. . |
| 5,203,681 | 4/1993 | Cooper . |
| 5,209,641 | 5/1993 | Hoglund et al. . |
| 5,286,163 | 2/1994 | Amra et al. . |
| 5,308,045 | 5/1994 | Cooper . |
| 5,310,412 | 5/1994 | Gilbert et al. . |
| 5,330,328 | 7/1994 | Cooper . |
| 5,364,078 | 11/1994 | Pelton . |
| 5,454,423 | 10/1995 | Tsuchida et al. . |
| 5,470,201 | 11/1995 | Gilbert et al. . |
| 5,558,505 | 9/1996 | Mordue et al. . |
| 5,586,863 | 12/1996 | Gilbert et al. . |
| 5,634,770 | 6/1997 | Gilbert et al. . |
| 5,662,725 | 9/1997 | Cooper . |
| 5,678,807 | 10/1997 | Cooper . |
| 5,685,701 | 11/1997 | Chandler et al. . |

FLOW-DIRECTING DEVICE FOR MOLTEN METAL PUMP

FIELD OF THE INVENTION

The present invention relates to a system and device for releasing gas into molten metal and, in particular, for releasing gas into a flow of molten metal and ensuring that the gas mixes with the molten metal.

BACKGROUND OF THE INVENTION

It is known in the art of smelting and purifying metals to introduce gas into molten metal to remove impurities. Specifically, when processing molten aluminum, it is desirable to remove dissolved gases, particularly hydrogen, and to remove dissolved metals, particularly magnesium. Those skilled in the art refer to removing dissolved gas from molten aluminum as "degassing," and refer to removing magnesium as "demagging." Nitrogen or argon is generally released into molten metal for degassing purposes while chlorine gas is generally used for demagging.

When demagging or degassing aluminum, gas is released into a quantity of molten aluminum, this quantity generally being referred to as a bath of molten aluminum. The bath is usually contained within the walls of a reverbatory furnace. The present invention can be used for either demagging or degassing purposes.

When demagging aluminum, chlorine is released into the bath and bonds, or reacts, with magnesium wherein each pound of magnesium reacts with approximately 2.92 pounds of chlorine to form magnesium chloride ($MgCl_2$). Several methods for introducing chlorine into a molten aluminum bath are disclosed in the prior art. For example, it is known to introduce a flux containing chlorine into the bath, rather than introducing chlorine gas. Such a flux may contain a double salt of chlorine, such as CRYOLITE. It is also known to employ an apparatus whereby nitrogen or argon gas is introduced through a hollow rotating shaft utilizing an apparatus known as a rotary degasser. Another apparatus is a gas-injection system including a pump having a discharge, a metal-transfer conduit extending from the discharge and a gas-injection conduit connected to the top of, and extending into, the metal-transfer conduit. Molten aluminum is pumped through the metal-transfer conduit and gas is injected through the gas-injection conduit into the upper portion of the pumped molten metal moving through the metal-transfer conduit.

Other prior art includes: (a) a molten metal pump and gas-injection apparatus whereby gas is introduced through a tube into a passage and is released into molten metal entering the pump inlet; (b) a gas-treatment apparatus comprising: (i) a purification device, which is immersed in a molten metal bath contained within a furnace, and (ii) a decanting and degassing tank located outside of the bath; (c) U.S. Pat. No. 5,662,725 to Cooper entitled "System And Device For Removing Impurities From Molten Metal," which discloses an apparatus that releases gas into the bottom or sides of a moving molten metal stream so as to better disperse the gas within the stream (the disclosure of this issued patent is incorporated herein by reference).

Specific examples of prior-art devices are disclosed in U.S. Pat. No. 3,650,730 to Derham et al., U.S. Pat. No. 3,767,382 to Bruno et al., U.S. Pat. No. 4,169,584 to Mangalick, U.S. Pat. No. 4,351,314 to Koch, U.S. Pat. No. 4,003,560 to Carbonnel, and U.S. Pat. No. 5,203,681 to Cooper.

One problem with the known gas-injection or gas-release devices is often that the gas is released through an opening formed at the end of a gas-injection conduit that extends into the molten metal stream from the top of a metal-transfer conduit through which the molten metal is being pumped or otherwise conveyed. When the molten metal stream moving through the metal-transfer conduit contacts the gas-injection conduit, it is obstructed by and diverted around the end of the gas-injection conduit creating a low pressure zone behind the end of the gas-injection conduit. At least some of the gas released through the opening of the gas-injection conduit immediately enters this low pressure zone, rises to the inner surface of the top of the metal-transfer conduit and is not dispersed within the moving molten metal stream. Much of the injected gas, therefore, remains in contact with the top of the metal-transfer conduit until it exits the metal-transfer conduit, at which point it completely separates from the flowing molten metal and rises to the surface of the molten metal bath. Therefore, the gas is not effectively dispersed within the molten metal stream passing through the conduit, and the percentage of chlorine that actually bonds with magnesium to form $MgCl_2$ is relatively low. As it will be appreciated by those skilled in the art, the greater the dispersion of gas within the molten metal stream, the greater the demagging efficiency because a higher number of molecules contact metal molecules, thus giving more molecules a chance to interact and bond to form $MgCl_2$. Improving the efficiency of the demagging process is highly desirable. It reduces material costs because less chlorine gas is used. Furthermore, chlorine gas that does not bond with magnesium either bonds with aluminum to form aluminum bichloride, an undesirable contaminant, or rises to the top of the molten metal bath and escapes into the atmosphere, where it is an undesirable pollutant.

SUMMARY OF THE INVENTION

The present invention solves these and other problems by eliminating the low pressure zone behind a gas-release conduit (or other gas-release or gas-injection device) which may be inserted into a confined space, such as a metal-transfer device, through which molten metal is pumped or otherwise conveyed. Alternately, the gas-release conduit is outside of an enclosed space and extends into a moving stream of molten metal in the metallic bath.

The present invention is a flow-directing device comprising a block of heat-resistant material that is mounted at least partially behind the end of a gas-release device, such as a gas-release conduit, which preferably extends into a metal-transfer device, such as a metal-transfer conduit or a discharge within a pump casing. If the gas-release device is inserted into a metal-transfer device, the flow-directing device is preferably either mounted inside of or formed as part of the metal-transfer device. The flow-directing device preferably fills the space that would otherwise be a low pressure zone behind the gas-release device while permitting a substantially smooth flow; its dimensions depend on the distance D the gas-release device extends into the metal-transfer conduit, the width W1 of the gas-release device, the location of the gas-release device in relation to the flow-directing device and on standard fluid flow and pressure characteristics. In a preferred embodiment, the end of the gas-release device that extends into the metal-transfer device has a width of approximately 1" to 3" (ie., W1=1" to 3") and preferably extends 1' to 3" into the metal-transfer device (i.e., D=1" to 3"). In the preferred embodiment, the flow-directing device is 5" to 10" in length. The width (W2) of the upstream (or leading edge) of the flow-directing device is dependent upon W1 and the position of the gas-release device relative the flow-directing device. In one embodiment, where the leading edge is positioned immediately behind the gas-release device, W2 is preferably equal to the width W1 of the gas-release device. In this embodiment it is preferred that the sidewalls of the flow-directing device taper outward to a maximum width (W3) of about 1.3 times W2.

In another embodiment, the gas-release device is positioned in a cavity formed in the flow-directing device between the leading edge and the trailing edge. In this embodiment the leading edge of the flow-directing device is preferably rounded and the sides of the flow-directing device flair outward to a preferred maximum width of W3 equal to W1.

The maximum width W3 of the flow-directing device depends on the position of the gas-release device relative the flow-directing device. If the gas-release device is positioned at the leading (or upstream) edge of the flow-directing device, W3 is preferably greater than W2. If the gas-release device is located between the leading edge and trailing edge of the flow-directing device, W2 is preferably less than W1 and W3 is equal to W1. Each embodiment of the flow-directing device has a preferred height H equal to at least one-half D.

Also disclosed herein are metal-transfer devices specially designed to receive a flow-directing device and a molten metal pump including a flow-directing device.

DETAILED DESCRIPTION OF A PREFERRED EMBODIMENT

Figure 1:
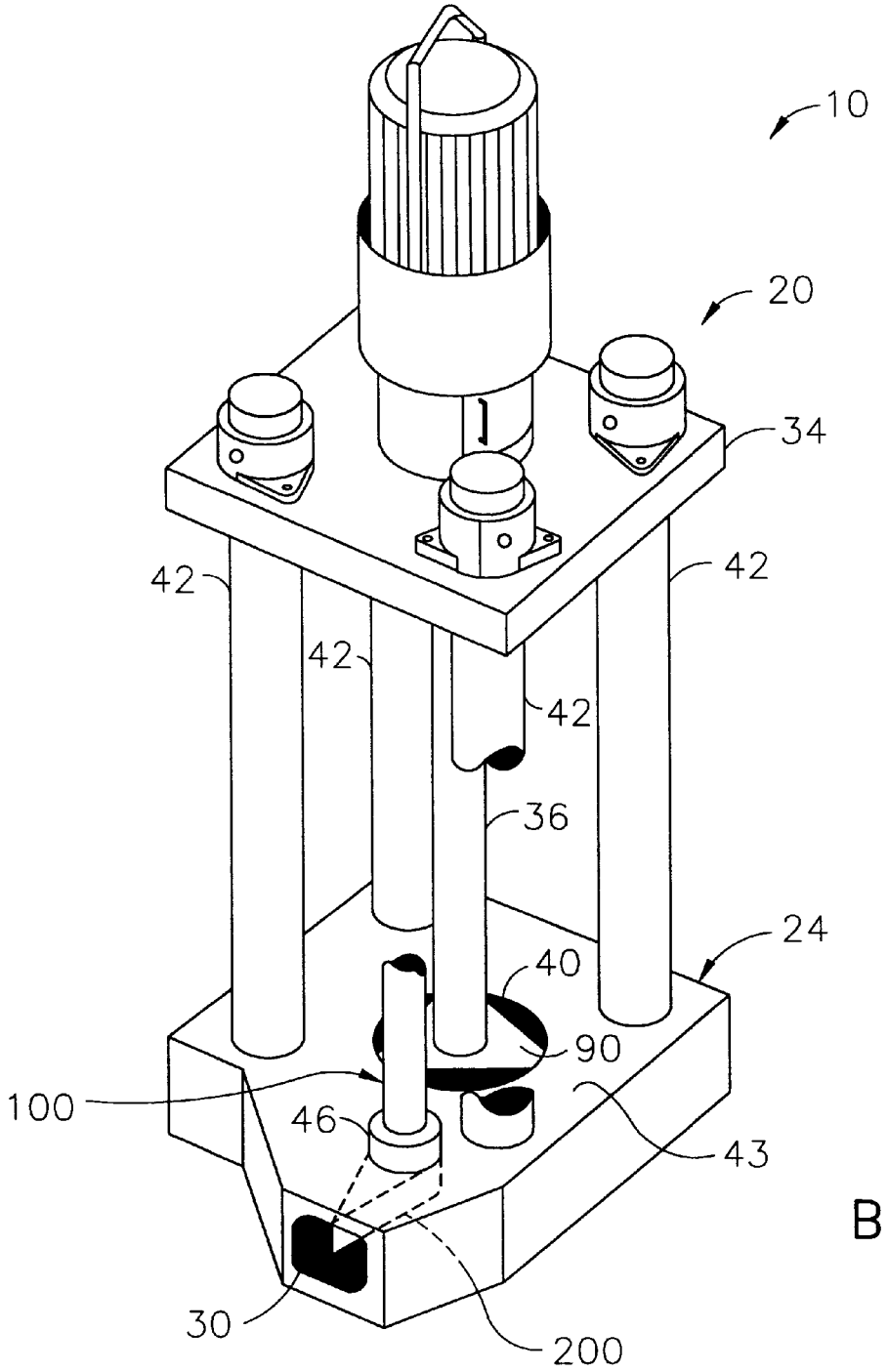
FIG. 1 is a perspective view of a pump for pumping molten metal that includes a flow-directing device according to the invention.
Figure 2:
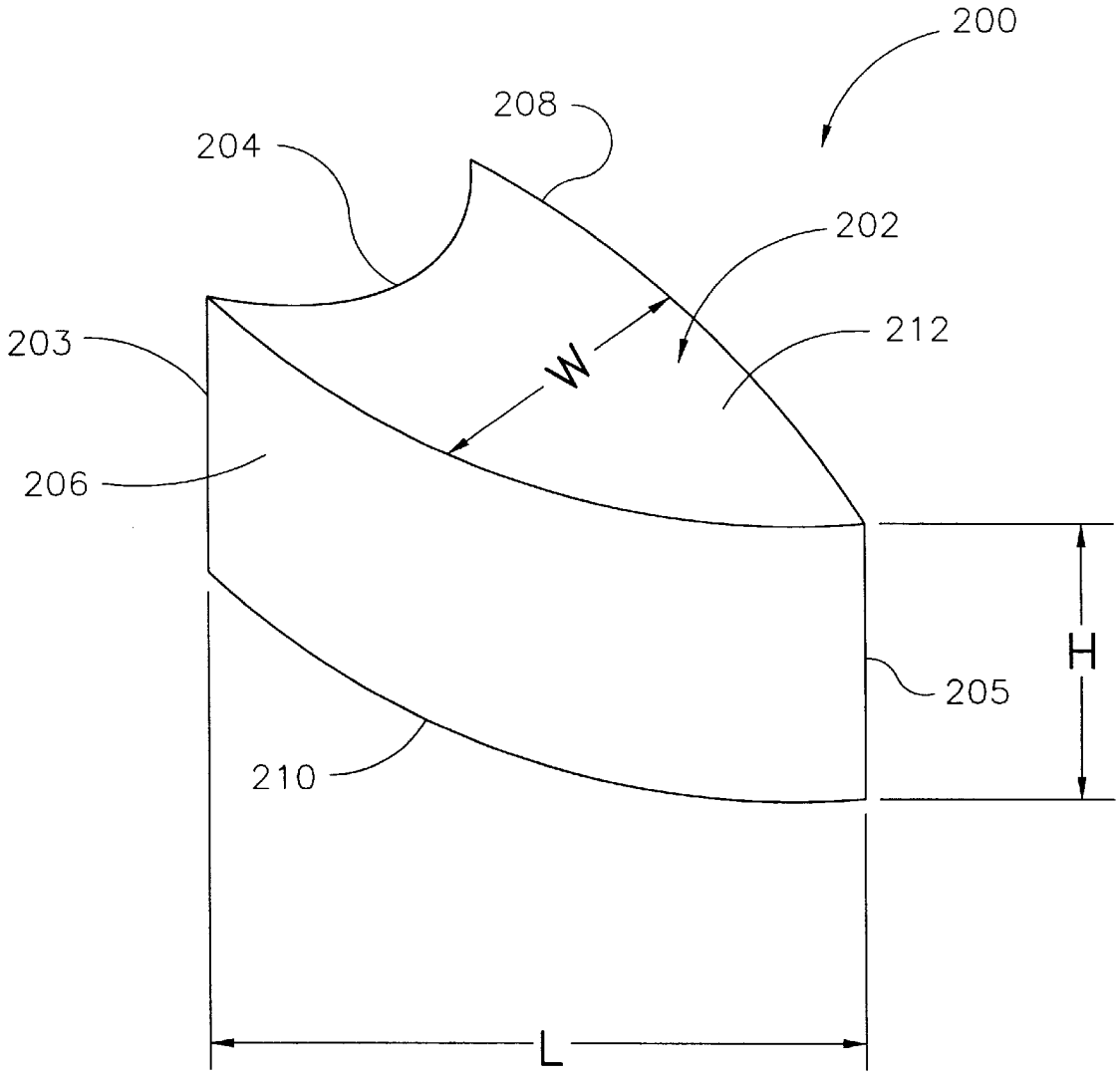
FIG. 2 is a front perspective view of a flow-directing device according to the invention.

Referring now to drawings where the purpose is to illustrate and describe a preferred embodiment of the invention, and not to limit same, FIG. 1 shows a system 10 in accordance with the present invention. System 10 includes a pump 20, a gas-release device 100, and a flow-directing device 200.

Pump 20 is specifically designed for operation in molten metal furnaces or in any environment in which molten metal is to be pumped. Pump 20 can be any structure or device for pumping or otherwise moving molten metal whereby the metal is moved preferably at a velocity of at least 5 ft./sec. and most preferably at a velocity of 10 ft./sec. or faster preferably through a restricted opening to form a stream or flow of molten metal. The preferred minimum velocity of 5 ft./sec. is required so that the gas released into the moving molten metal stream is swept into the stream instead of simply rising vertically through the stream. Thus, a higher velocity improves the interaction between the gas and the molten metal. A preferred pump 20 is disclosed in U.S. Pat. No. 5,203,681 to Cooper entitled "Submersible Molten Metal Pump," the disclosure of which is incorporated herein by reference.

Figure 3:
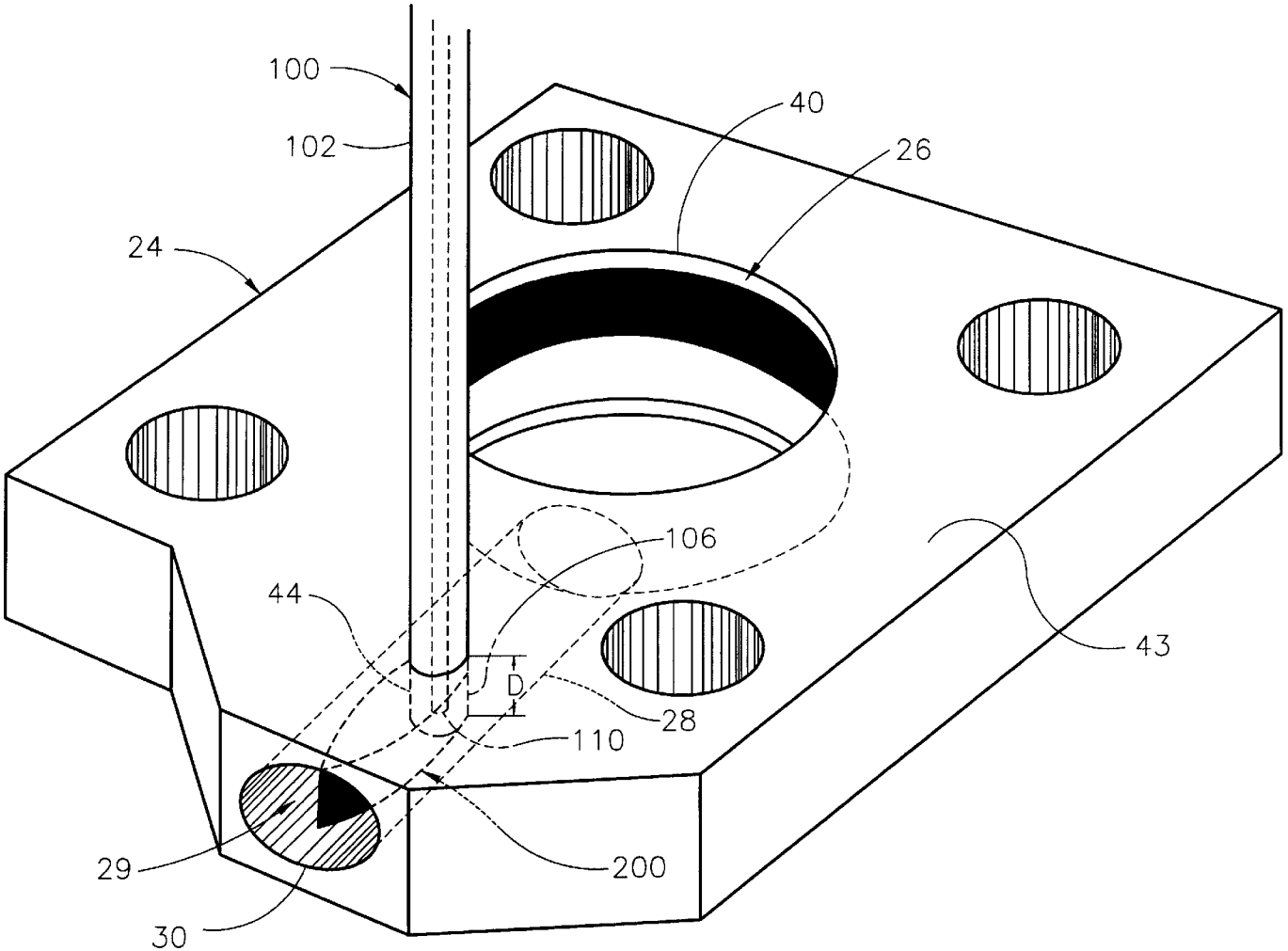
FIG. 3 is a top perspective view of a pump base including the flow-directing device shown in FIG. 2.
Figure 5:
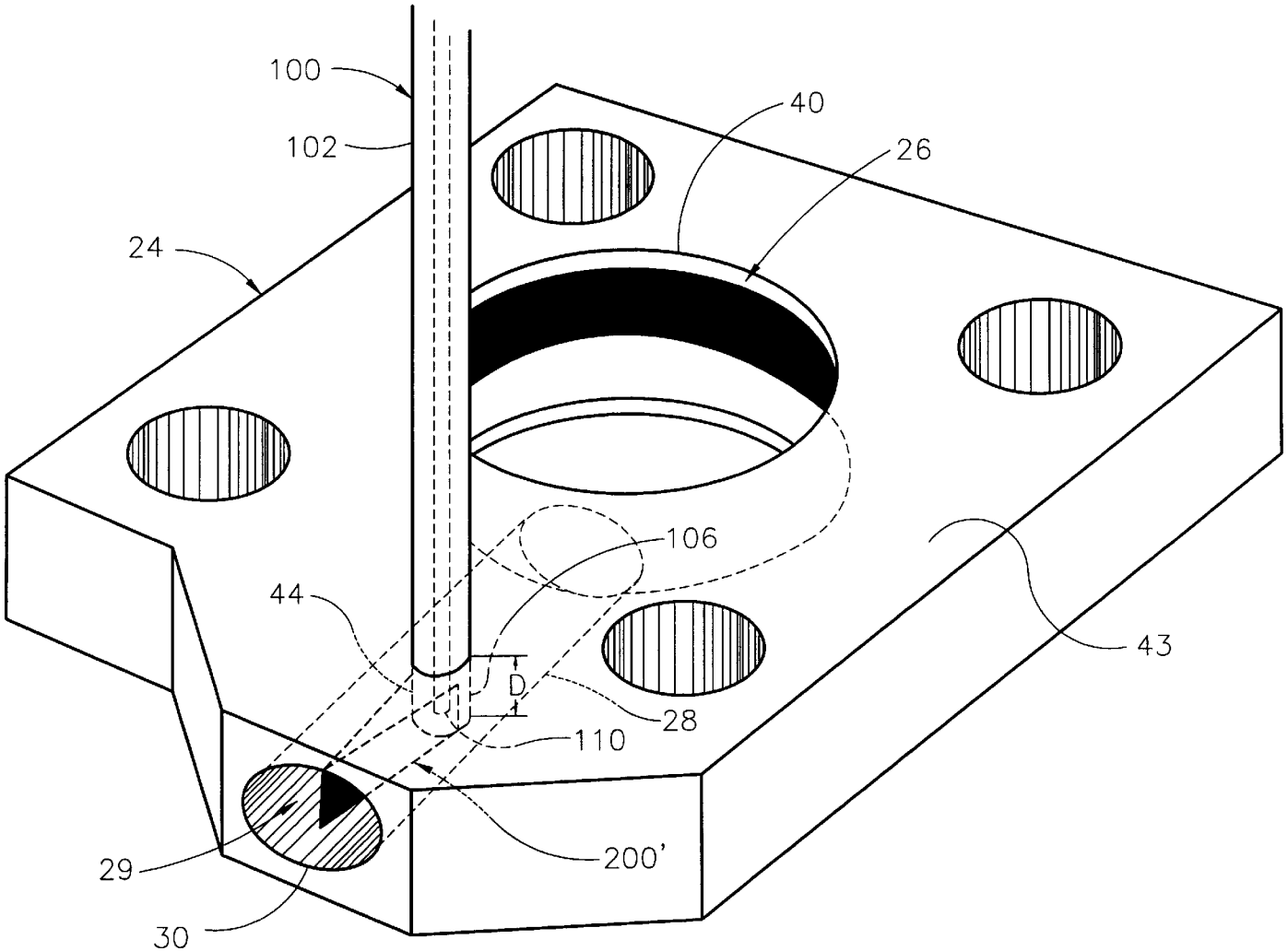
FIG. 5 is a top perspective view of a pump base including the alternate embodiment of the flow-directing device shown in FIG. 4.

Basically, the preferred embodiment, which is best seen in FIG. 1, of pump 20 has a pump base 24, best shown in FIGS. 3 and 5, submersible in a molten metal bath B. Pump base 24 preferably includes a generally cylindrical pump chamber 26 (although chamber 26 may include a volute or be of any shape) having inlet 40 at the top (alternatively, inlet 40 could be at the bottom of chamber 26), a tangential discharge 28 having a top surface 29, an outlet port 30 and an imperforate rotor, or impeller, 90 (although another impeller, such as a bird-cage impeller may be used). Support posts 42 connect base 24 to a super structure 34 of the pump thus supporting super structure 34. A rotor drive shaft 36 is connected at one end to rotor 90 and at the other end to a coupling (not shown), which is connected to a motor shaft (not shown). Base 24, rotor 90, drive shaft 36 and support posts 42 are preferably comprised of oxidation-resistant graphite.

As is shown, a gas-release device 100 preferably comprises an elongated conduit, or tube, 102. Tube 102 is preferably formed of graphite and impregnated with oxidation-resistant solution, this material being readily available and well known to those skilled in the art. All graphite components described herein could instead be formed of refractory material instead of graphite, refractory referring to any ceramic that would function in a molten metal environment. In a preferred embodiment, tube 102 has an outside diameter, or width (W1), of 1 to 3 inches and an inside diameter of ⅜ inch to ¾ inch, it being understood that tubes having other dimensions, or shapes other than cylindrical, could also be used. Tube 102, has a first end (not shown) and a second end 106. The first end has an opening (not shown) and second end 106 has an opening 110, best seen in FIG. 3.

Figure 3B:
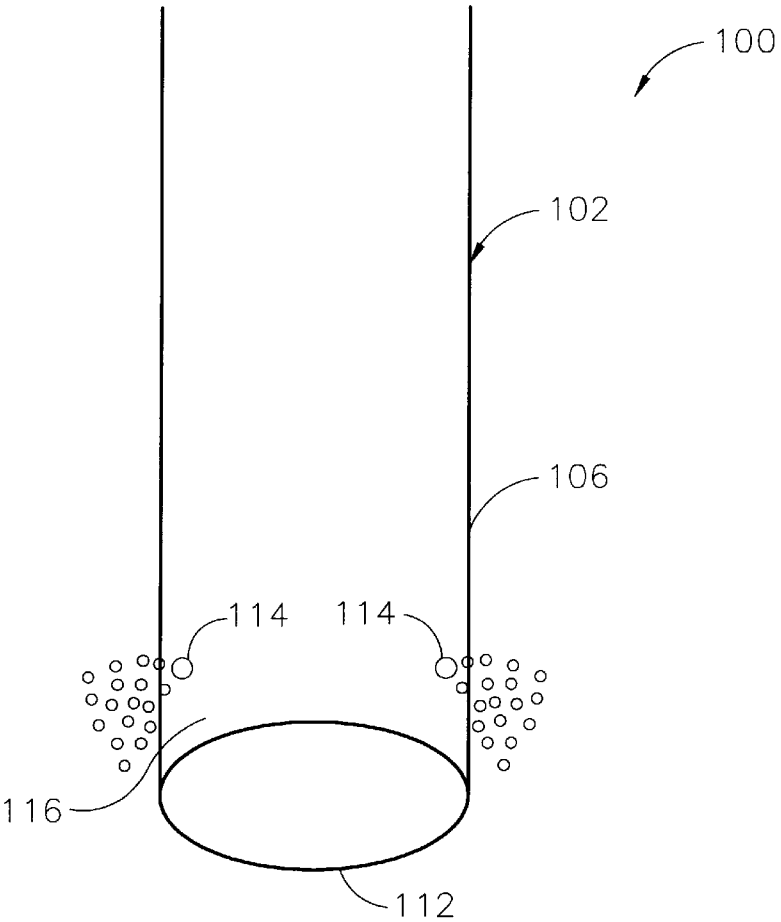
FIG. 3B is a perspective view of a gas-transfer device according to the inventor with openings formed in its side.
Figure 3A:
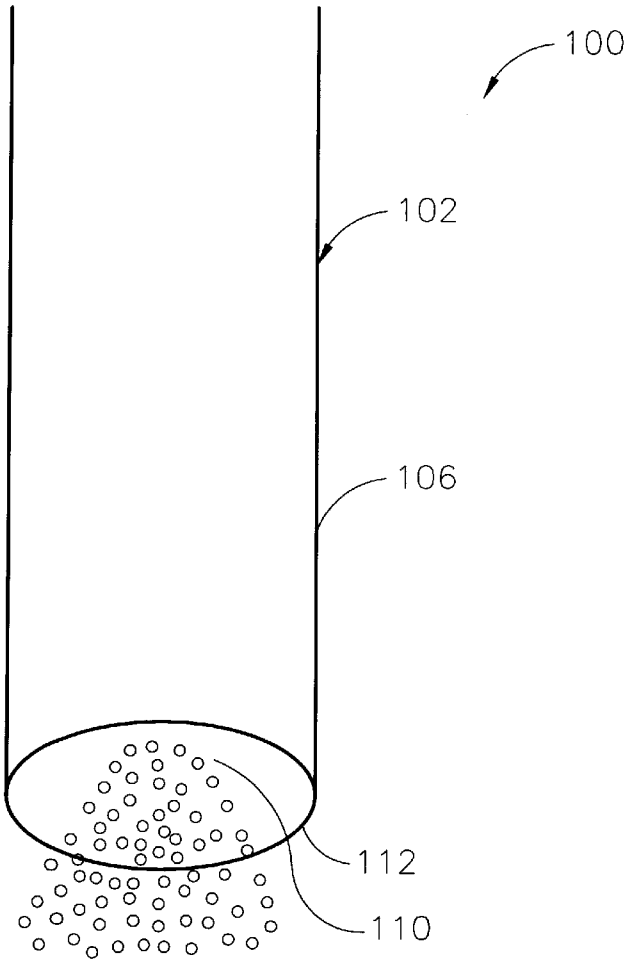
FIG. 3A is a perspective view of a gas-transfer device according to the invention with an opening formed in the bottom.

Base 24 includes a top wall 43. A bore 44 extends through top wall 43 into tangential discharge 28. A mounting and securing plug 46 may be affixed to wall 43 above bore 44 (although plug 46 may not be used). If a plug 46 is used, tube 102 is positioned so that second end 106 extends through plug 46, which secures tube 102, and extends through bore 44 and into tangential discharge 28 by a distance D, as measured vertically from top surface 29 to the bottom of end 106. Alternatively, tube 102 may be secured by to plug 46 and may extend from bore 44 into discharge 28 by a distance D. As used herein, the term gas-release device refers to any arrangement or number of tubes, openings or apparatus for releasing gas into a molten metal stream. Therefore, as used herein, D refers to the distance into the stream at which gas is introduced. In the preferred embodiment, D is equal to 1"

to 3". As shown in FIG. 3A, gas may be released from an opening 110 formed in the bottom 112 of second end 106. Alternatively, as shown in FIG. 3B, bottom 112 may be plugged in which case gas may be released from one or more openings 114 formed in the side 116 of second end 106.

In operation, a gas supply is connected to an opening (not shown) of tube 102, and gas is introduced into the hollow cavity of tube 102, the gas then being released through opening 110 at second end 106 and being dispersed into the molten metal stream flowing through tangential discharge 28.

Flow-directing device 200 generally comprises a solid block 202, preferably formed of oxidation-resistant graphite, although any material, such as silicon carbide or other ceramic, capable of functioning in a molten metal environment could be used. Device 200, however, need not be solid and can be of any shape, so long as its configuration and dimensions are such that it substantially fills the low pressure zone behind end 106 of gas-release device 100. The dimensions of device 200 (or devices 200', 250 and 550, which are described herein) will vary according to the distance D that gas-release device 100 extends into discharge 28, the width W1 of second end 106 of gas-release device 100, the position of gas-release device 100 relative flow-directing device 200 and on known fluid flow and pressure characteristics. Furthermore, while any of the flow-directing devices described herein must be positioned downstream of the gas-release device to fill the low-pressure zone, none need to be positioned entirely downstream of the gas-release device. Therefore, as used herein, the term downstream used in relation to the position of the flow-directing device means that at least part of the flow-directing device is downstream of the gas-release device.

Preferably, the height H of device 200 is equal to or greater than ½ D, and most preferably, equals D. The width (W2) of the leading edge device 200 at a position closest to gas-release device 100 is preferably equal to W1. The width (W3) of device 200 at its widest point is preferably equal to 1.1 to 2.0 (most preferably 1.3) times W1. The length L of device 200 is preferably between 5" and 10" and is preferably at least equal to W3. In the embodiment shown, end 106 is 1" to 3" in width (W1), extends a distance D of 1" to 3" into discharge 28 and is positioned 7" (to centerline) from outlet 30.

As shown, flow-directing device 200, which is preferably block 202, has a leading (or upstream) edge 203 including semi-cylindrical recess 204 designed to receive end 106. Block 202 has a height H equal to D and includes two radiused sides 206, 208 that curve gradually outward until block 202 reaches a preferred maximum width W3 of 1.3 times W2, then sides 206, 208 curve inward until they meet at trailing (or downstream) edge 205. The total length of block 202 as shown is approximately 7". Top surface 212, which in operation is positioned against the inner wall of top surface 29 of discharge 28, and bottom surface 210 are preferably substantially flat, although they need not be. For example, bottom surface 210 may be sloped downward and/or may be contoured. If surface 210 is sloped downward, flow-directing device 200 preferably has a maximum height H, measured at the lowest point of surface 210, of ¼"–¾" greater than D.

Figure 4:
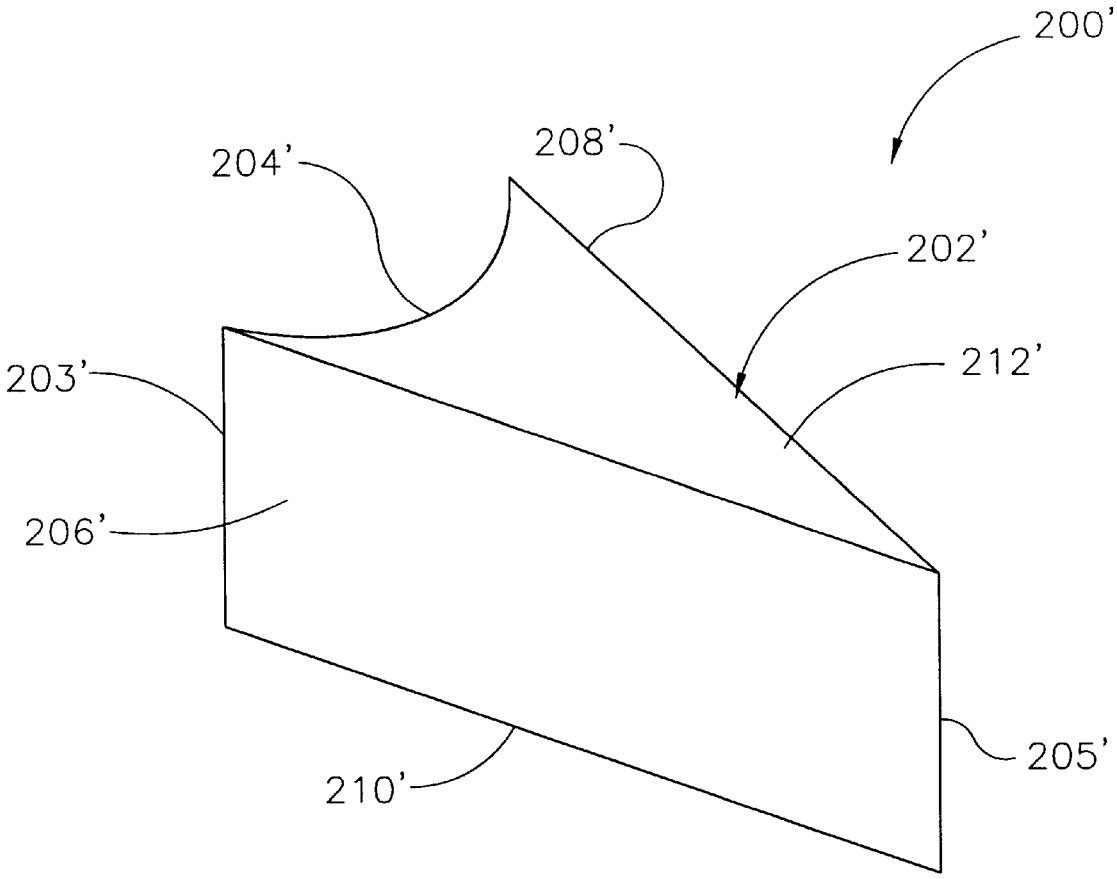
FIG. 4 is a front perspective view of an alternate embodiment of the flow-directing device according to the invention.

An alternate embodiment is shown in FIG. 4 where block 202' has planer, tapered sides 206', 208' that meet at second end 205'. Top surface 212" and bottom surface 210' are preferably substantially flat although they could be tapered or angled or have a contoured surface. FIG. 5 shows the embodiment of FIG. 4 mounted in the base of a molten metal pump.

Figure 6:
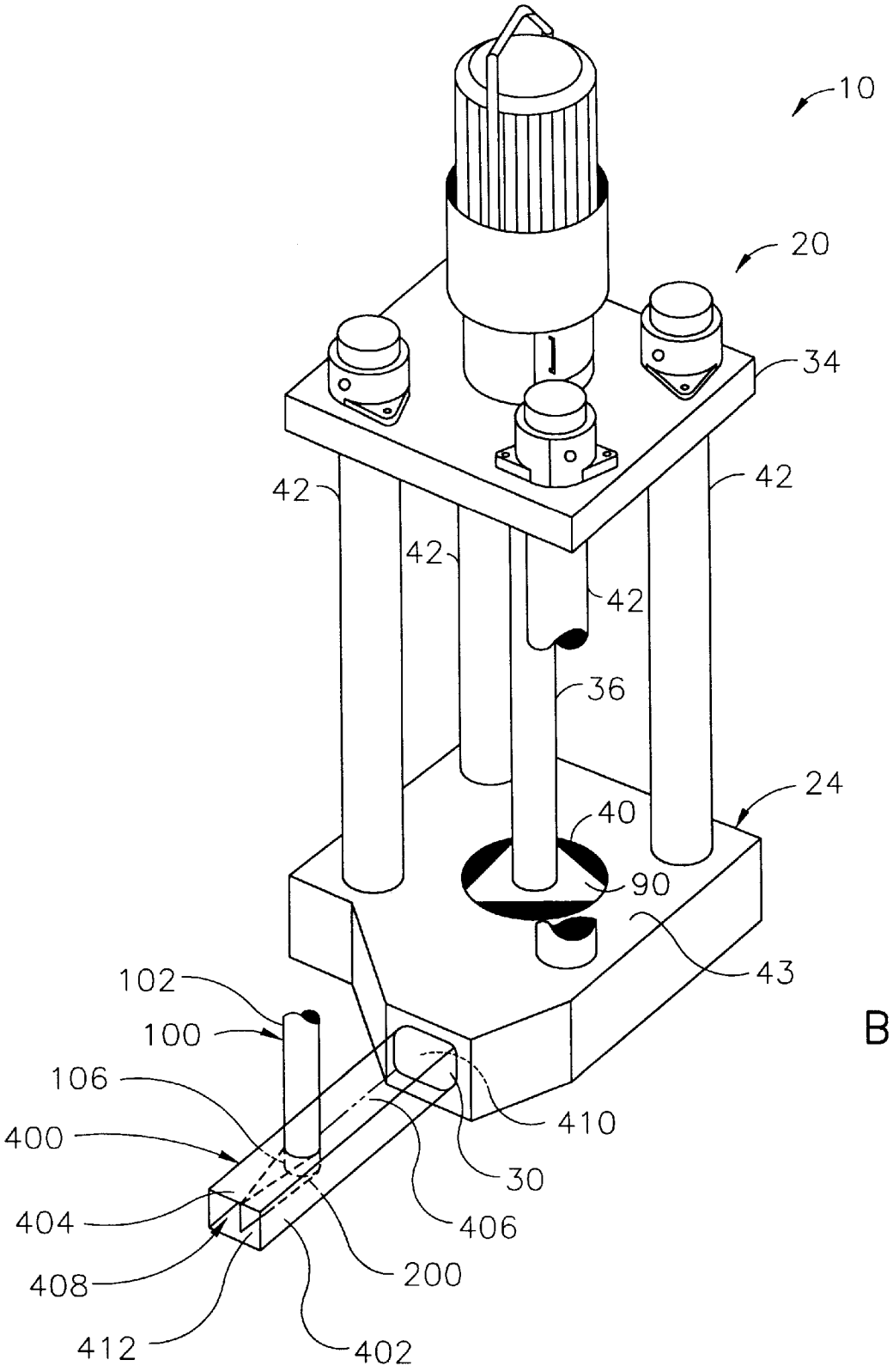
FIG. 6 is a perspective view of a pump including a metal-transfer conduit extending from the pump outlet and having a flow-directing device according to the invention positioned in the metal-transfer conduit.

Another embodiment of the invention is shown in FIG. 6 wherein a system is shown that includes a metal-transfer device 400 connected to, or otherwise extending from, outlet 30. Metal-transfer device 400 is preferably a metal-transfer conduit 402 having an upper wall 404, with an inside surface 406, a channel 408, an inlet 410 and an outlet 412. As used herein, the term metal-transfer device refers to any totally enclosed or partially enclosed structure which can, at least partially, contain a molten metal stream or flow. The metal-transfer device may be the pump discharge or a separate metal-transfer conduit in communication with the pump outlet.

The enclosed portion of the metal-transfer device which contains the molten metal flow is hereinafter referred to as a channel. Some preferred shapes of a metal-transfer device 400 of the present invention are semi-circular, u-shaped, v-shaped, circular, rectangular, square or rectangular with two or more radiused sides, or three-sided with an open bottom. It will be understood that, if the metal-transfer device is open on one side, for example, if the metal-transfer device is u-shaped, semi-circular, v-shaped or 3-sided, the open side faces downward. Furthermore, the metal-transfer device may include baffles that break the molten metal stream into two or more separate streams traveling through two or more channels defined within the metal-transfer device. The preferred metal-transfer conduit of the present invention is a fully enclosed conduit, such as conduit 402, having a length of 12–48 inches. Conduit 402 preferably has a square or rectangular outer profile and includes a channel 408 having a preferred width of approximately 3–6" and a preferred height of 3–4". Metal-transfer conduit 402 may be attached to the outlet port of a pump or be formed as part of a pump base extending from the outlet port or be a separate structure from the pump base and not be attached to, but instead simply be positioned so that the channel can communicate with the pump outlet port. The term communicate, when used in this context, means that at least part of the molten metal stream exiting the outlet port enters the channel defined by the metal-transfer conduit Utilizing the gas-release conduit described previously in this disclosure and one of the flow-directing devices described herein, the dispersion of gas within a molten metal stream confined by a metal-transfer conduit can be greatly enhanced thereby greatly improving the efficiency of demagging or degassing molten metal. As shown in FIG. 6, gas-release device 100 extends into channel 408 of metal-transfer conduit 402 through upper wall 404. In the embodiment shown, dimensions, including those of flow-directing device 200 (which is preferably either block 202 or 202', although device 250 or 550 may be used instead), are the same as described herein.

In operation, a pump creates a molten metal stream which exits the outlet port and travels through channel 408 of metal-transfer device 400, moving from inlet 410 to outlet 412. A gas source (not shown) provides gas to first end (not shown) of gas-release device 100, the gas traveling through tube 102 and exiting end 106 and passing into channel 408. The gas enters the molten metal stream passing along sides 206, 208 and bottom 210 of flow-directing device 200 and is dispersed within the molten metal stream.

Preferably, discharge 28 or metal-transfer conduit 402 communicating with outlet 30 are especially designed to receive flow-directing device 200, and include a recess or other locating device such as a pin or bore (not shown) to properly locate and seat device 200. This allows for quick and efficient installation of device 200, which may then be secured by any number of conventional means including threaded connectors or cement. Additionally, device 200 may be integrally formed with the upper surface of discharge 28 or surface 406 of conduit 402.

Figure 7:
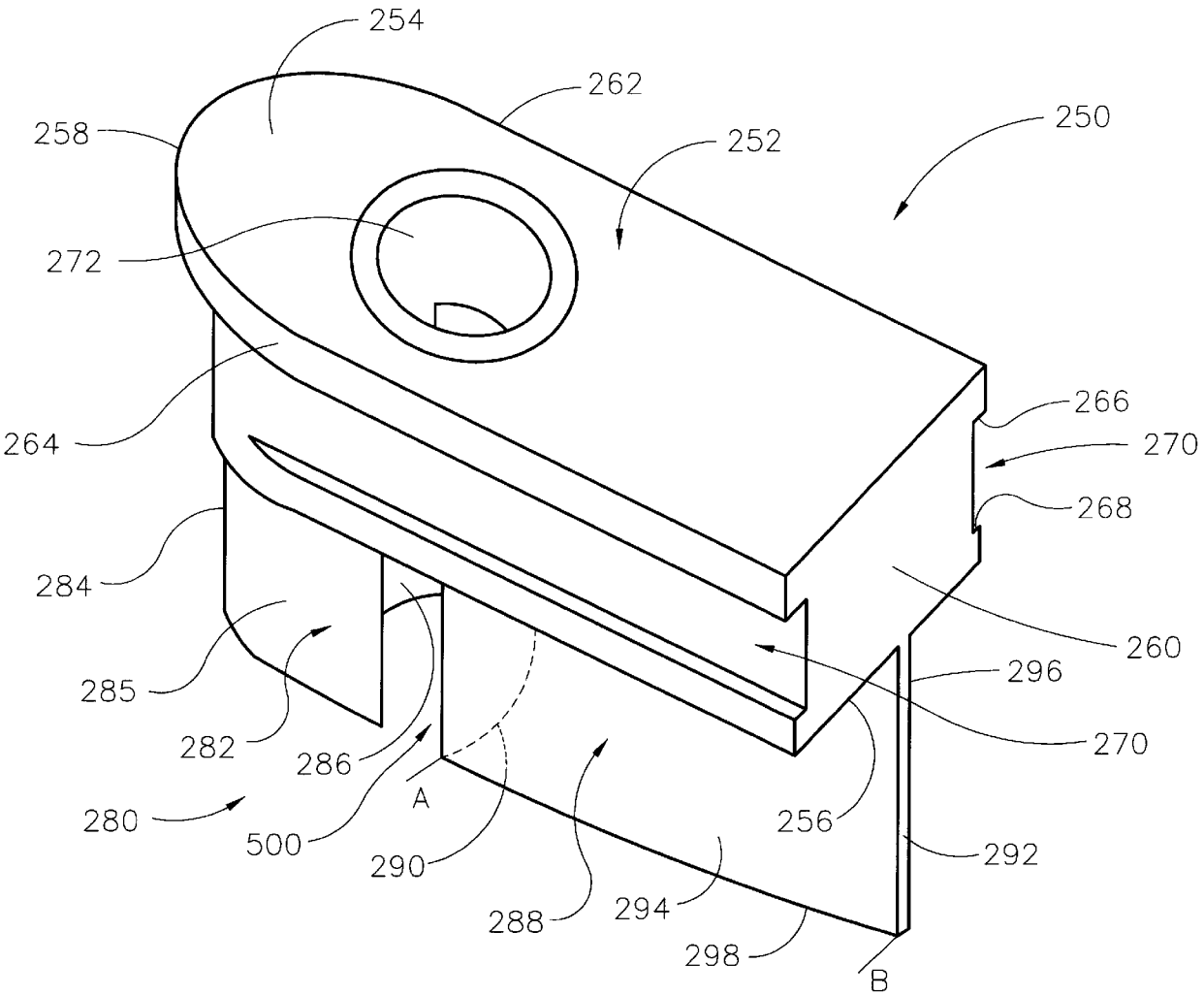
FIG. 7 shows an alternate embodiment of the invention having a slot for mounting to a metal-transfer device and a cavity for receiving a gas-release device.

An alternate embodiment of the invention is shown in FIG. 7. Flow-directing device 250 includes a mounting portion 252 and a flow-directing portion 280. Portion 252 has a top surface 254, a bottom surface 256, a curved leading edge 258, a squared trailing edge 260, a first side 262 and a second side 264. An upper lip 266 and lower lip 268 is formed on each side 262 and 264. A channel 270 is defined between each lip 266 and 268. Together, lips 266 and channels 270 form what is commonly referred to as a T-groove which fits into a corresponding T-slot formed into the upper wall of a metal-transfer device (shown in FIG. 10). Before mounting device 250 onto the T-slot in a metal-transfer device cement is preferably placed in each channel 270. The cement adheres flow-directing device 250 to the metal-transfer device. When device 250 is mounted in a metal-transfer device, bottom surface 256 is preferably flush with the top wall of the channel defined by the metal transfer device. Therefore, only flow-directing portion 280 extends into the channel.

The flow-directing portion 280 is designed to direct the molten metal stream and eliminate the low pressure zone created by the presence of a gas-transfer device within the stream. In the embodiment shown, section 280 has a front portion 282 that includes a curved leading edge 284 and a concave inner surface 286. A back portion 288 has a concave inner surface 290, a trailing edge 292, a first side surface 294, a second side surface 296 and a bottom surface 298. A cavity 500 is defined between opposing concave surfaces 286 and 290; cavity 500 communicating with opening 272. Opening 272 and cavity 500 are of the proper shape and dimension to receive a gas-release device such as previously described tube 102.

Surfaces 294 and 296 may flare outward to a maximum width W3 between points A and B on back portion 288 and then flare inward to a thin cross-section at position B. It is preferred, however, that the maximum width W3 of portion 280 is approximately equal to the width of gas-release device 100 (not shown). Bottom side 298 preferably is flat or angled downward moving from position A to position B. If angled downward H of portion 280, measured at the lowest point of side 298, which is adjacent position B, is ¼ inch to ½ inch greater than the distance D that gas-release device 100 (not shown) extends into the channel of the metal-transfer device (not shown).

Figure 8:
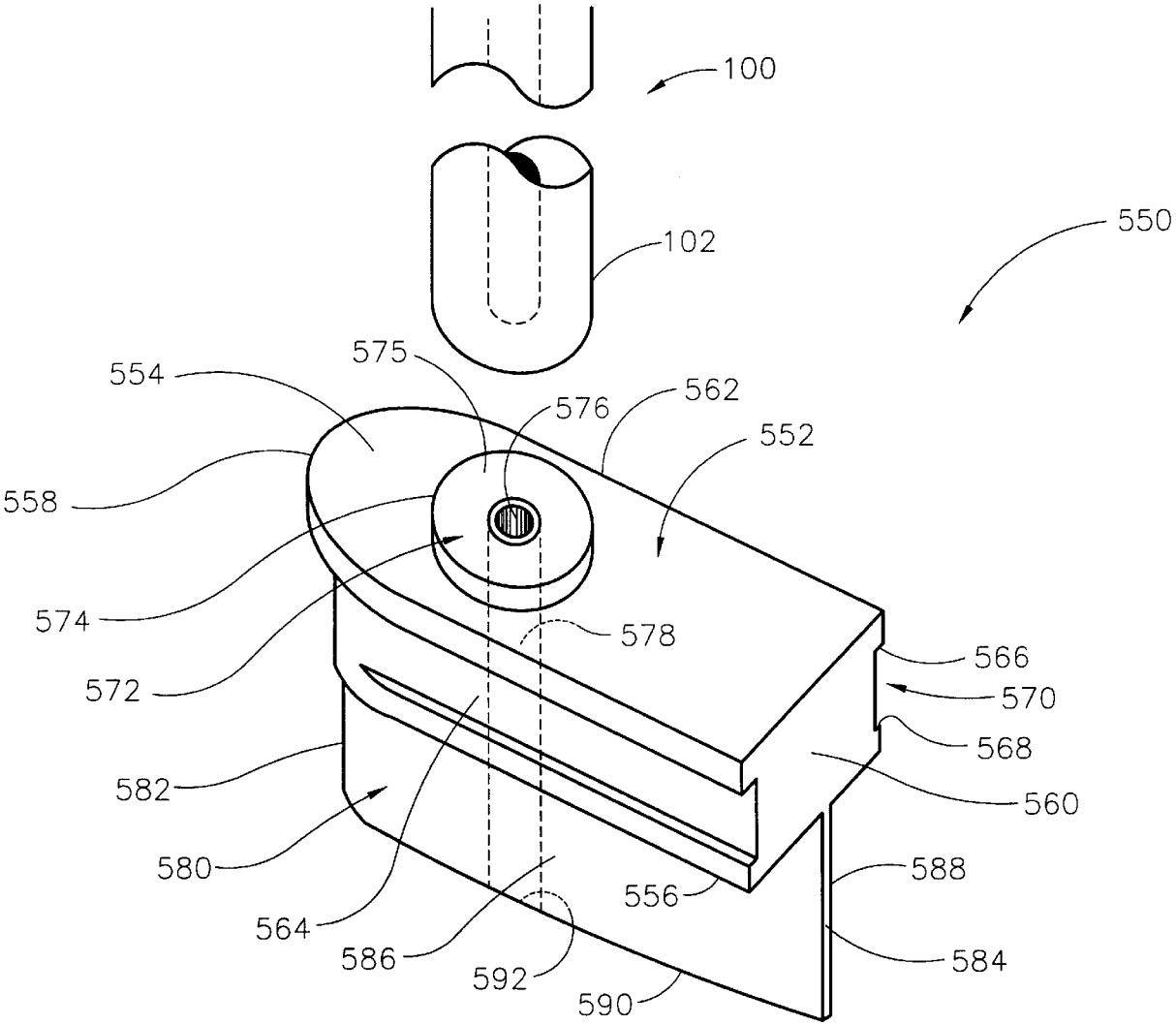
FIG. 8 shows an alternate embodiment of the invention having a slot for mounting to a metal-transfer device and a plug to which a gas-release device can be mounted.

Another embodiment of the invention is shown in FIG. 8. Flow-directing device 550 includes a mounting portion 552 and a flow-directing portion 580. Portion 552 has a top surface 554, a bottom surface 556, a curved leading edge 558, a squared trailing edge 560, a first side 562 and a second side 564. An upper lip 566 and a lower lip 568 are formed on each side 562, 564. A channel 570 is defined between each lip 566 and lip 568. Together, lips 566 and channels 570 form what is commonly referred to as a T-groove which fits into a corresponding T-slot formed into the upper wall of a metal-transfer device (shown in FIG. 10). Before mounting device 550 onto the T-slot in a metal-transfer device cement is preferably placed in each channel 570. The cement adheres flow-directing device 550 to the metal-transfer device. When device 550 is mounted in a metal-transfer device, bottom surface 556 is preferably flush with the top wall of the channel defined by the metal transfer device. Therefore, only flow-directing portion 580 extends into the channel. A plug 572 is mounted to or formed as part of top surface 554. In the preferred embodiment, plug 572 is cylindrical having an annular outer surface 574 and a top surface 575. An opening 576 is defined in surface 575. An elongated cavity 578 is in communication with opening 576 and passes through flow-directing device 550.

The flow-directing portion 580 is designed to direct the molten metal stream and eliminate the low pressure zone behind the position at which gas is released into the stream. In the embodiment shown, portion 580 has a curved front section 582, a back edge 584, a first side 586, a second side 588 and a bottom surface 590. An opening 592 is formed in surface 590; opening 592 being in communication with cavity 578.

Sides 586 and 588 may flare outward so that portion 580 will reach a maximum width W3 that is greater than the width of opening 592 (W1) downstream of opening 592. It is preferred, however, that the maximum width W3 of portion 580 is equal to W1. Bottom side 590 preferably is flat or angled downwards. If angled downwards, side 590 has its lowest point adjacent trailing edge 584. H, as measured from this lowest point on surface 590, is ¼ inch to ½ inch greater than D.

Figure 9:
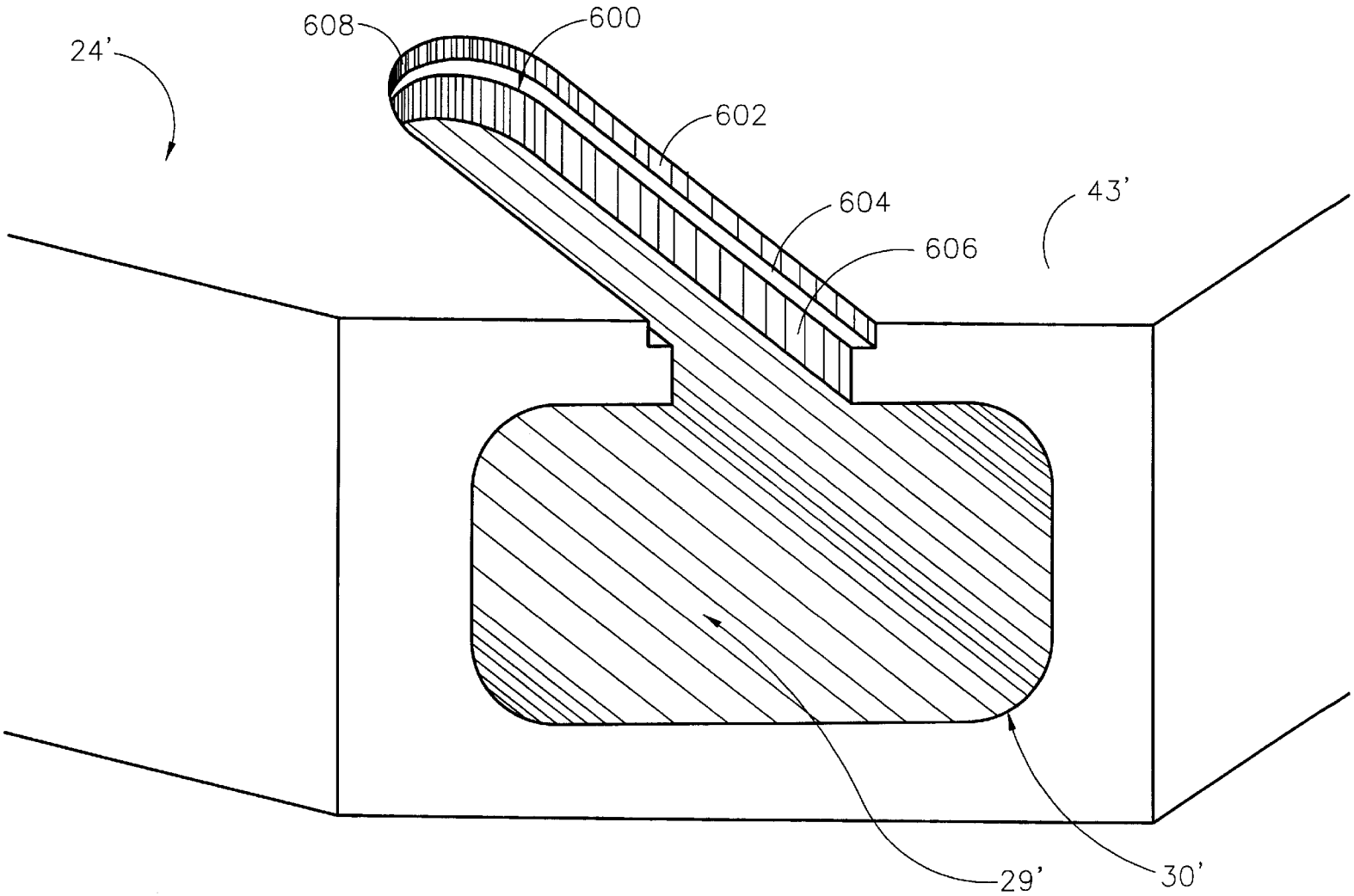
FIG. 9 shows a metal-transfer device including a T-slot for receiving a flow-directing device including a T-groove.

FIG. 9 shows a metal-transfer device in the form of pump discharge 28' having a T-slot 600 formed therein for receiving the T-groove formed in the mounting portion 252 of device 250 or mounting portion 552 of device 500.

T-slot 600 is preferably formed in surface 43' of base 24' and includes a vertical wall 602, a horizontal wall 604 and a secondary vertical wall 606. T-slot 606 preferably has a curved edge 608.

Device 200, 250 or 550 need not be used with a pump. Either could be used in conjunction with metal-transfer device 400 through which a flow of molten metal is generated. Such a flow could be generated by gravity or other means.

Figure 10:
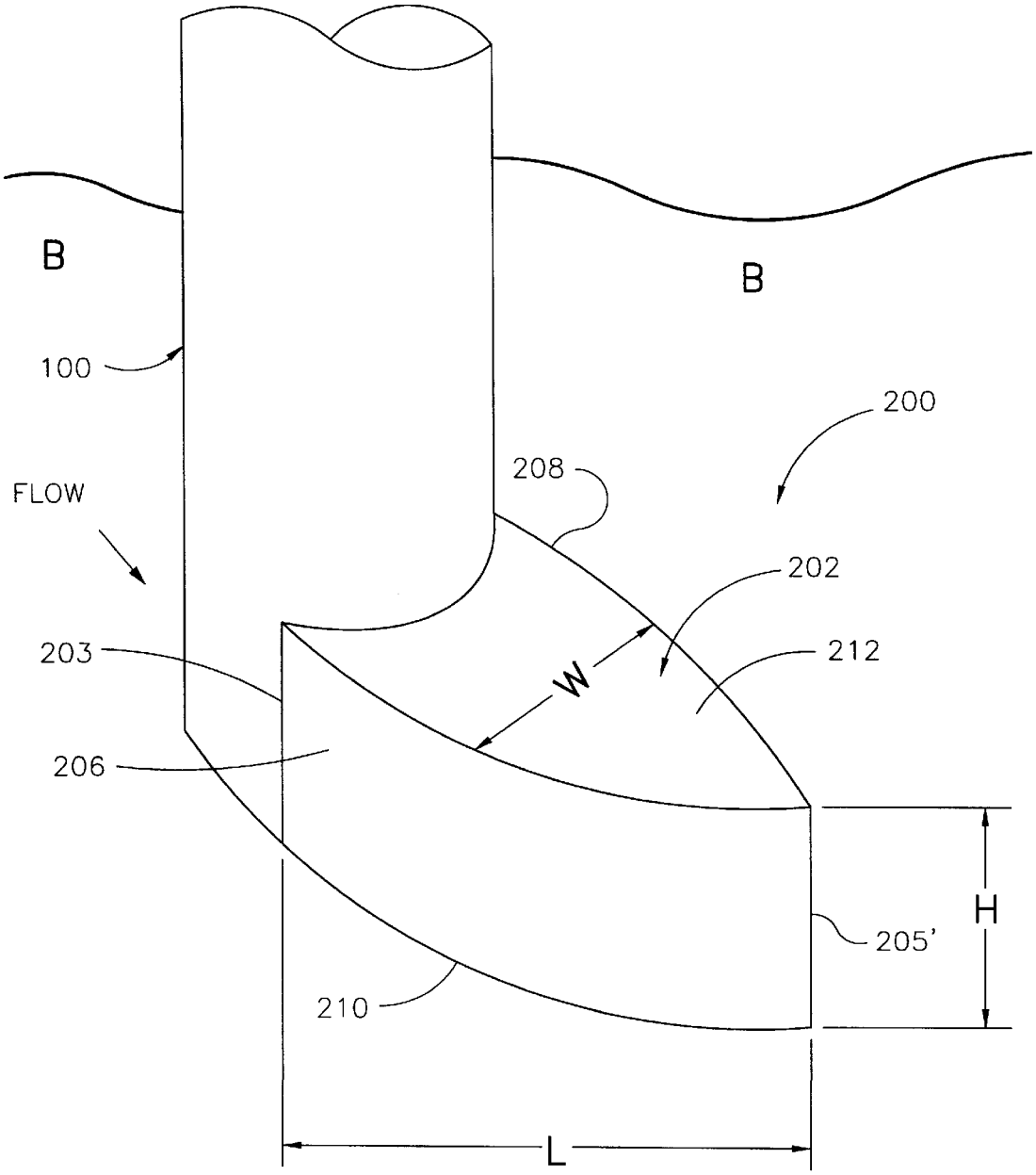
FIG. 10 is a perspective view of an apparatus including a gas-release device in combination with a flow-directing device according to the invention.

Additionally, device 200, 250 or 550 need not be used in an enclosed space. Once a flow of molten metal is created, either by a pump, gravity or other means, a gas-release device, such as conduit 102, may be inserted into the flow to release gas into the flowing molten metal. In such an arrangement, a flow-directing device 200 may still be used to direct the flow, block the low pressure zone behind the gas-release device, and improve the dispersion of gas within the molten metal. Such an arrangement is shown in FIG. 10.

Having now described preferred embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A device for releasing gas into a molten metal stream, said device comprising:

(a) a pump for generating a molten metal stream, said pump having a pump base; said pump base having a top surface, a pump chamber and a discharge in communication with said chamber, said stream passing through said discharge, said discharge having a top wall;

(b) a gas-release device for introducing gas into said stream, said gas-release device having a first end connectable to a gas source and a second end that extends through the top wall of said pump chamber and into said discharge where it extends into the molten metal stream passing through the discharge; and (c) a flow-directing device positioned within said discharge along said top wall downstream of said second end of said gas-release device, said flow-directing device having a height H of at least half the distance D that said second end extends into said discharge;

whereby molten metal is pumped through said discharge past said second end of said gas-release device creating a low-pressure zone behind the gas-release device and gas is introduced into said first end of said gas-release device, the gas being released through said second end and being dispersed in said molten metal stream where it is diverted around said flow-directing device the flow-directing device at least partially filling the low-pressure zone.

2. The device as described in claim 1 wherein said flow-directing device is comprised of graphite.

3. The device as defined in claim 1 wherein said second end of said gas-release device has a bottom and one or more sides and gas is released through the bottom of said second end.

4. The device as defined in claim 1 wherein said second end of said gas-release device has one or more sides and a bottom and gas is released through a side of said second end.

5. The device as described in claim 1 wherein said flow-directing device has a height H substantially equal to the distance D that said gas-release device extends into said discharge.

6. The device as described in claim 1 wherein said flow-directing device has a height H greater than the distance D that said gas-release device extends into said discharge.

7. The device as described in claim 1 wherein said flow-directing device includes a recess designed to receive said second end of said gas-release device.

8. The device as described in claim 1 wherein said flow-directing device has a maximum width greater than the width of the second end of said gas-release device.

9. The device as defined in claim 1 wherein said flow-directing device has a maximum width equal to the width of the second end of said gas-release device.

10. The device as defined in claim 1 wherein said flow-directing device includes a cavity for receiving said gas-release device.

11. The device as described in claim 1 wherein said flow-directing device has a length of 5" to 10".

12. The device as defined in claim 1 wherein said flow-directing device has a mounting portion including a T-groove and said discharge has a top wall including a T-slot, said flow-directing device being mounted to said top wall by inserting said T-groove into said T-slot.

13. The device as defined in claim 1 wherein said gas-release device comprises an opening formed through said flow-directing device.

14. A pump base for use in a pump for pumping molten metal, said base including an inlet, a discharge and an outlet, said discharge including a mounting means for mounting a gas-release device and a mounting means for mounting a flow-directing device.

15. The pump base as defined in claim 14 wherein said mounting means is a T-slot.

16. The pump base as defined in claim 14 wherein said mounting means is a recess.

17. The pump base as defined in claim 14 further including a flow-directing device positioned in said mounting means.

18. A metal-transfer conduit for use in conveying a molten metal stream, said metal-transfer conduit including a top surface including a mounting means for mounting a gas-release device and a mounting means for mounting a flow-directing device.

19. The conduit as defined in claim 18 wherein said mounting means is a T-slot.

20. The conduit as defined in claim 18 wherein said mounting means is a recess.

21. The conduit as defined in claim 18 which further includes a flow-directing device positioned in said mounting means.

22. A system for releasing gas into a molten metal stream, said system comprising:

(a) means for generating a flowing molten metal stream;

(b) a metal-transfer device having an interior perimeter defining a channel through which the stream passes, said interior perimeter having a top surface;

(c) a gas-release device having a first end connectable to a gas source and a second end extending into said channel a distance of D through said top surface; and (d) a flow-directing device positioned within said metal-transfer device downstream of said gas-release device, the flow-directing device extending into said channel.

23. The system as defined in claim 22 wherein said metal-transfer device is a fully-enclosed conduit.

24. The system as defined in claim 22 wherein said flow-directing device has a height H greater than or equal to one-half D.

25. The system as defined in claim 22 wherein said flow-directing device has a height H greater than or equal to D.

26. The system as defined in claim 22 wherein said top surface includes a T-slot and said flow-directing device has a T-groove and said T-groove is inserted into said T-slot thereby attaching said flow-directing device to said metal-transfer device.

27. The system as defined in claim 22 wherein said gas-release device comprises an opening formed through said flow-directing device.

28. The system as defined in claim 22 wherein said means for generating a flowing molten metal stream is a pump comprising a motor, motor mount, support posts, a rotor shaft and a rotor.

29. The system as defined in claim 28 wherein said pump further comprises a pump base including a discharge, said discharge defining said metal-transfer conduit.

30. The system as defined in claim 28 wherein said pump further comprises a pump base including a discharge leading to an outlet, and said metal-transfer device is a metal-transfer conduit in communication with said outlet.

31. A method for releasing gas into a molten metal stream, said method comprising the steps of:

(a) providing means for generating a flowing molten metal stream;

(b) operating said means for generating a flowing molten metal stream to generate a stream of molten metal;

(c) providing a gas-release device having a first end connectable to a gas source and a second end extending into said stream of molten metal;

(d) providing a flow-directing device positioned downstream of said second end of said gas-release device, said flow-directing device positioned at least partially within said molten metal stream; and (e) supplying gas to said first end of said gas-release device, said gas being released into said molten metal stream through said second end.

32. The method as defined in claim 31 wherein said means for generating a flowing molten metal stream is a pump comprising a motor, a motor mount, support posts, a motor shaft, a rotor shaft and a rotor.

33. An apparatus for releasing gas into a stream of flowing molten metal, said apparatus comprising:

(a) a gas-release device having a first end connectable to a gas source and a second end extending into a molten metal stream; and (b) a flow-directing device disposed at least partially in the molten metal stream downstream of the second end of the gas-release device, said flow-directing device for directing the flow of molten metal and for at least partially filling a low pressure zone downstream of the second end of the gas-release device.

* * * * *